US011370606B2

(12) United States Patent
Garmendia

(10) Patent No.: US 11,370,606 B2
(45) Date of Patent: Jun. 28, 2022

(54) HOPPER-IN-FRAME FOR TRANSPORTING PROPPANT MATERIAL

(71) Applicant: UNCONVENTIONALOG S.A.S., Buenos Aires (AR)

(72) Inventor: Lisandro Garmendia, Provincia de Buenos Aires (AR)

(73) Assignee: UNCONVENTIONALOG. S.A.S., Buenos Aires (AR)

( * ) Notice: Subject to any disclaimer, the term of this patent is extended or adjusted under 35 U.S.C. 154(b) by 12 days.

(21) Appl. No.: 16/442,763

(22) Filed: Jun. 17, 2019

(65) Prior Publication Data

US 2020/0109005 A1 Apr. 9, 2020

(30) Foreign Application Priority Data

Oct. 9, 2018 (AR) ..... 20180102910

(51) Int. Cl.
*B65D 88/30* (2006.01)
*B65D 90/02* (2019.01)
*B65D 88/12* (2006.01)

(52) U.S. Cl.
CPC ..... *B65D 88/30* (2013.01); *B65D 88/121* (2013.01); *B65D 90/027* (2013.01)

(58) Field of Classification Search
CPC ..... B65D 88/30; B65D 90/027; B65D 88/121
See application file for complete search history.

(56) References Cited

U.S. PATENT DOCUMENTS 2,838,805 A * 6/1958 Donald ..... B65D 88/30 52/143
2019/0002196 A1* 1/2019 Lucas ..... B65D 90/20

* cited by examiner

*Primary Examiner* — Saul Rodriguez
*Assistant Examiner* — Willie Berry, Jr.
(74) *Attorney, Agent, or Firm* — Defillo & Associates; Evelyn A Defillo

(57) ABSTRACT

A hopper-in-frame for transporting granular proppant material, such as oil well sands subjected to fracturing, having a top loading through a hatch in the roof and lateral gravity discharge opening at the level of the hopper floor and not below the hopper through a lower side discharge opening where the load asymmetry is compensated for by the inclusion of an asymmetric roof that includes at least a portion of the roof asymmetrically lowered, such as a sloping roof or sloping to the side of the wall of download. The hopper-in-frame is supported and delimited by a frame that in turn is compatible to be incorporated in intermodal cargo containers.

3 Claims, 4 Drawing Sheets

CUT A-A

HOPPER-IN-FRAME FOR TRANSPORTING PROPPANT MATERIAL

FIELD OF THE TECHNIQUE

The present Utility Model is related to a hopper-in-frame for transporting granular proppant material such as sands for oil wells subjected to fracturing. In the hopper-in-frame of the present Utility Model, the frame supports and delimits the hopper in such a way that it is also compatible to be incorporated in intermodal freight containers, being the main improvement of the present Utility Model obtaining a lateral discharge by gravity at the level of the hopper floor and not below the hopper and the assurance of a safe transport, thanks to the inclusion of an asymmetric roof of load compensation.

PREVIOUS ART

As one skilled in the art knows, hoppers-in-frame, meaning, the hoppers mounted in a frame, or assemblies of hoppers in the frame, offer cargo containers that allow bulk materials to be stored inside it to be transported to the reception site or use thereof. Due to the rigor of the use, the hoppers and their frames (support structure) are usually constructed of metallic material, and for this purpose, plates, profiles, welds, and various types of fittings are combined to connect and articulate the various parts and components; thus, obtaining a fully functional hopper that generally includes an upper loading hatch and lower discharge opening, usually designed to include the hatch in the upper part of the hopper and the discharge opening in the bottom of the hopper with a generally symmetrical construction type, meaning, where the upper loading hatch and the discharge opening, as well as the walls of the hopper, both of those straight, as those that make ramps, or with inclined surfaces, are replicated as a mirror in symmetry planes as a passive and natural way to ensure the load balance.

Typical examples of more or less complex hoppers-in-frame with conventional distribution of its cargo hatch(es) and discharge opening(s) can be observed in the patent application US2014166647 that discloses an upper loading hatch or double loading hatch, depending on the case, in the latter case compensated symmetrically, and a discharge opening generally centered on the bottom of the hopper-funnel, mainly with the intention for allowing to successively stack one-hopper on top of another and all of them mounted in the containers, thus allowing the bulk material to be loaded into the already stacked hoppers, even loading the one under the pile, that is, loading/unloading all the hoppers once they are already stacked, in other words, loading/unloading in tandem. However, said type of hoppers-in-frame, included in intermodal type containers, discharge their contents from the bottom of the hopper, that is, from the lower central part of the container, and for this reason, they need motorized machines to elevate and unload its content, or to have adapted facilities able to withdraw from the inside of the hopper its content, since the same will only leave by gravity action below the container itself.

Other proposals of the prior art, as can be seen in the patent application US2013004272, also have symmetrical hoppers with a discharge opening in the lower part thereof, being able to arrange one or more upper loading hatches, and proposing a pressurized discharge by means of the lateral connection pipes also symmetrically arranged on the bottom of the hopper.

However, both proposals, and the designs known to date, all have the funnel hopper end or hopper in the central lower part of the hopper itself and with symmetric hopper configuration to avoid off-centering and load balancing during the transport. Due to the above, there is currently a certain difficulty to obtain a rapid discharge by the gravity of the material that is efficient and comfortable at the reception and use site. For this reason, there is still a need to have a hopper-in-frame that can be connected in a simple way to a sleeve or conveyor belt on the side of the container and allows the gravity discharge of the material contained within the hopper, and that same time allows safe and balanced transport of the load.

To this end, and intending to allow an easy unloading at the reception site and use of the fracturing sand or support agent, the present Utility Model proposes asymmetric hopper with the lateral discharge of material by gravity, and that does not resort to the symmetry of the known hoppers of the previous art, and still allows the safe and balanced transport of the load, thanks to a special combination of bottom and asymmetric roof, as will be described in detail below.

SUMMARY OF THE UTILITY MODEL

The present Utility Model is aimed at providing a hopper-in-frame that can be transported and remain during loading and unloading on standard trucks, thus allowing to load faster at the origin site and download faster at the destination site with respect to the traditional procedures, such as loading of sandbags, pneumatic hoppers, traditional containers, and hopper or containers with inferior discharge under the bottom of the same, which require even excessive distraction time and use of the resources and auxiliary facilities.

The object of this Utility Model is to minimize and even completely eliminate the use of lifting devices, forklifts, dump trucks and cranes in the oil field, also reducing the amount of personnel required for oil field unloading operations.

It is, therefore, the object of the present Utility Model to provide a hopper-in-frame for transporting proppant material, where the frame is built with beams, posts, and metal profile suspenders holding said hopper and delimiting it within an exterior shape of generally a quadrangular prism, the frame results compatible with its incorporation into standard cargo containers of corrugated walls including connecting corners at its vertices, where the hopper comprises a lateral wall that includes at least one lower lateral discharge opening lockable by a corresponding lower lateral gate, a bottom having a plurality of inclined walls which converge towards the corresponding lower lateral discharge opening, a roof including at least one upper cargo hatch lockable by a corresponding upper gate, wherein said roof includes at least a portion of the roof lowered asymmetrically towards the side of the discharge wall.

BRIEF DESCRIPTION OF THE FIGURES

For better understanding, the present Utility Model has been illustrated in the accompanying figures; the illustrations comprise partial section views, and certain simplifications or particular forms of realization that one skilled in the art will readily understand.

For the disclosure purpose, particularly preferred embodiments are illustrated herein as follows.

DETAILED DESCRIPTION OF THE UTILITY MODEL

For the descriptive purposes of the present Utility Model, it has been exemplified through certain preferred forms of realization, although this does not constitute any limitation to put into practice the teachings introduced by the present Utility Model through other forms of equivalent embodiment by one skilled in the art.

In this regard, the present Utility Model is illustrated as being implemented through the preferred embodiments as illustrated in FIGS. 1 to 9. The inventors of the present Utility Model have selected, in particular, these examples of preferred forms because they have been considered the most representative Utility Model and those of greatest interest, in the point of view of teaching as the practical application in the current market.

Figure 1:
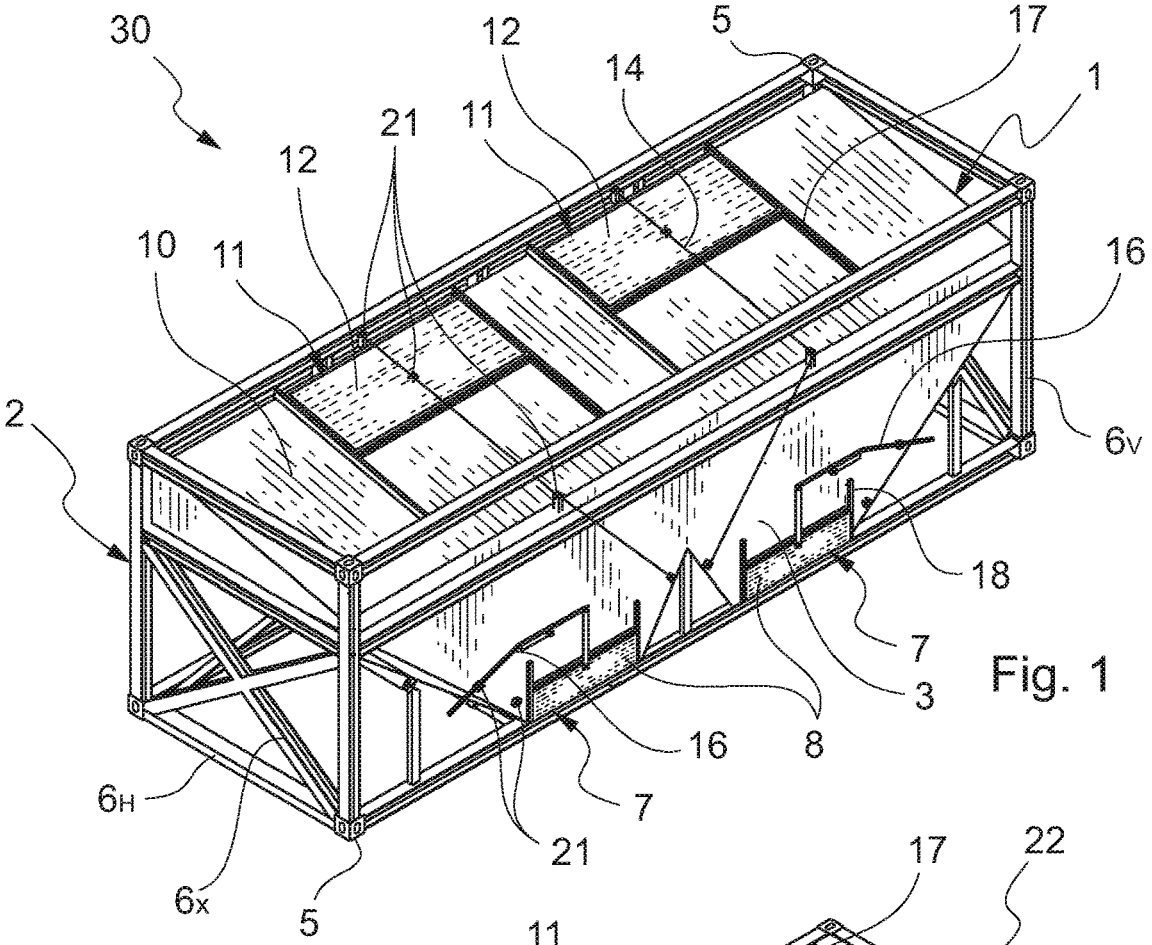
FIG. 1 illustrates a first preferred embodiment of the hopper-in-frame, including the improvements introduced through the present Utility Model with a design of two loading hatches and two lower lateral openings for unloading.

A hopper-in-frame (30), as illustrated in FIG. 1, generally includes a hopper (1) suitable to contain, transport, and discharge bulk granulated material (for example, sands suitable as proppant material in oil wells subjected to fracturing, a technique best known in the jargon as "fracking"), the hopper (1) being supported and delimited in a frame (2) that is built with beams (6H), posts (6V), and braces (6X) of metal profiling and with a generally quadrangular prismatic outer shape (meaning, octahedral or tetragonal), preferably the frame (2) includes connecting corners (5) (for example, twist-lock type) in its vertices.

Figure 2:
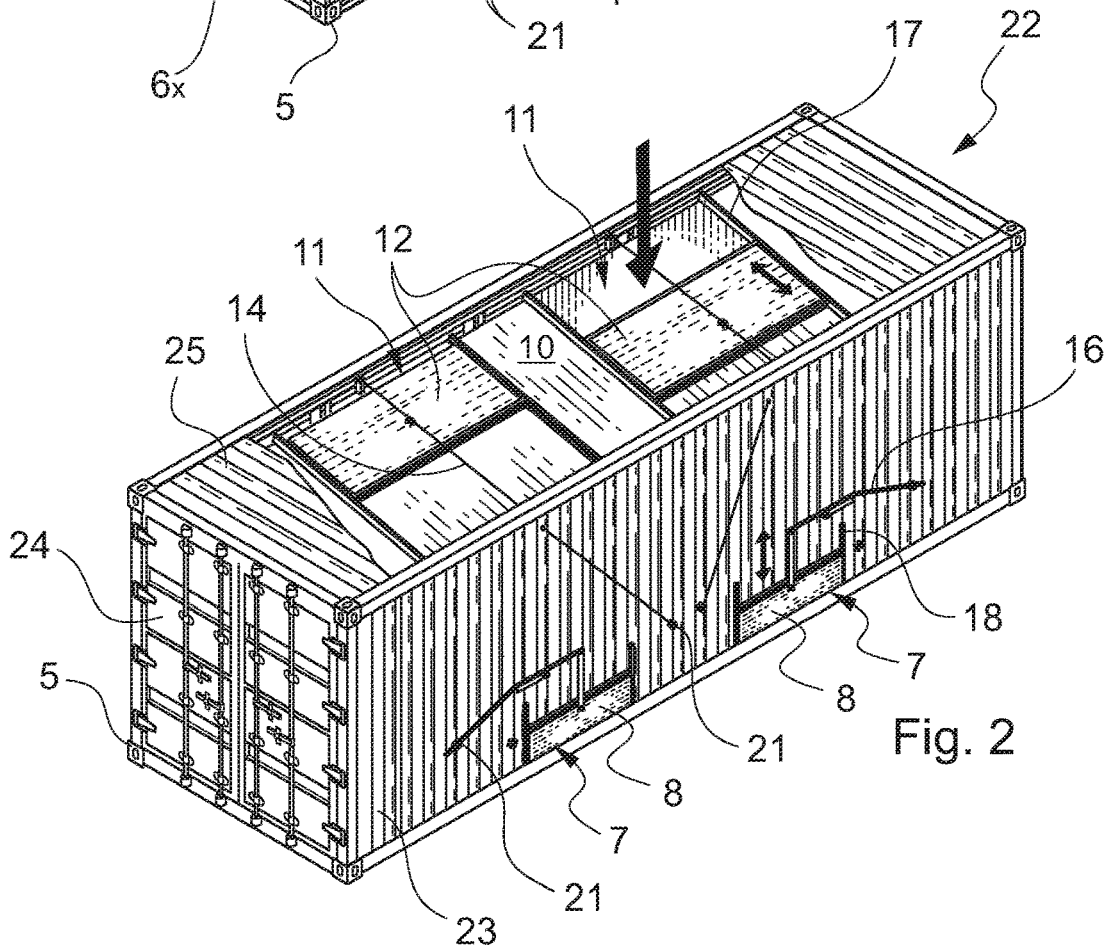
FIG. 2 illustrates the hopper-in-frame of FIG. 1, included in a standard container for intermodal transport, meaning, a standardized container of the type commonly used for maritime and truck transportation.

As illustrated in FIG. 2, the proposed hopper-in-frame (30) (meaning, a hopper mounted on a frame) is fully compatible to be introduced or even to be constructed within standard intermodal loading containers of the type of corrugated walls (22) for intermodal transport. Namely, intermodal containers (meaning, "ISO containers"), are standardized and turn out to be modular, interlink-able containers that can be exchanged from one transportation device to another, for example, between ship, train, truck, etc. and that usually are between a container model and another that usually varies merely its length. The reference measurements of the containers are based on their length in feet, conventionally 20 feet, 40 feet, 45 feet, 53 feet, etc. (in metric measures approximately 6.1 m, 12.2 m, 13.7 m, 16.15 m respectively).

For this reason, in the exemplary forms of the present Utility Model, an essential functional structure referred to herein as a hopper-in-frame (30) will be described, which will be able to adopt the preferred design dimensions by a manufacturer without thereby being limited to the standard measures now marketed in the market.

For example, the inventors of the present Utility Model have implemented a hopper-in-container (30) with a length of 26 feet (about 8 m) obtaining excellent structural and functional results, however depending on the final length of the container or transport platform that one wishes to use, the length can be extended or shortened without any limitation, being simply considered that depending on the length of the hopper-in-container (30), one, two or more loading hatches (11) and one, two or more lateral discharge openings (7). For the particular case of a hopper-in-container of 26 feet (about 8 m), it has been very convenient to incorporate two loading hatches (11) and two lateral discharge openings (7), to further optimize the loading and unloading times by gravity, as well as the loading capacity of the hopper itself.

It will be obvious to a person skilled in the art that the form of manufacture of the hopper (1), the frame (2) and the rest of the structural accessories can be made based on various manufacturing, metallurgical, carpentry and known industrial. The hopper (1) can be manufactured preferably with smooth, cut, folded and welded metal sheet, and the frame (2) can be fabricated with welded metal profiles, among many other joining techniques between parts and components. Therefore, the type of manufacturing process, sheet thickness, and profile sizes used, do not constitute any limitation or difficulty to the purposes of the present Utility Model and therefore do not require further description.

The frame (2) that supports and delimits the hopper (1) has a quadrangular prismatic form, meaning octahedral, similar to the containers known in the market. In particular, the self-supporting structure of the frame (2) is obtained by interconnecting (for example, welding) "double T", "C", "T", etc. metallic profiles, in such a way as to obtain a support structure with generally vertical posts or columns (6V), beams, crossbars (6H) generally horizontal, and tie rods (6X) oriented obliquely and conveniently connecting various anchor points to give rigidity to the set.

Figure 3:
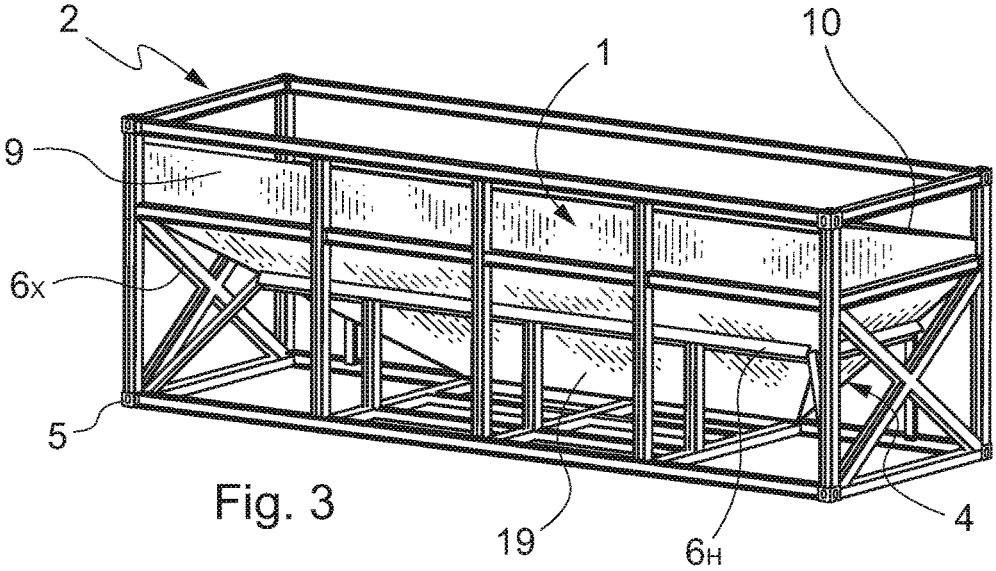
FIG. 3 is a perspective view illustrating the hopper-in-frame from the opposite side to the discharge lateral wall according to FIG. 1.
Figure 4:
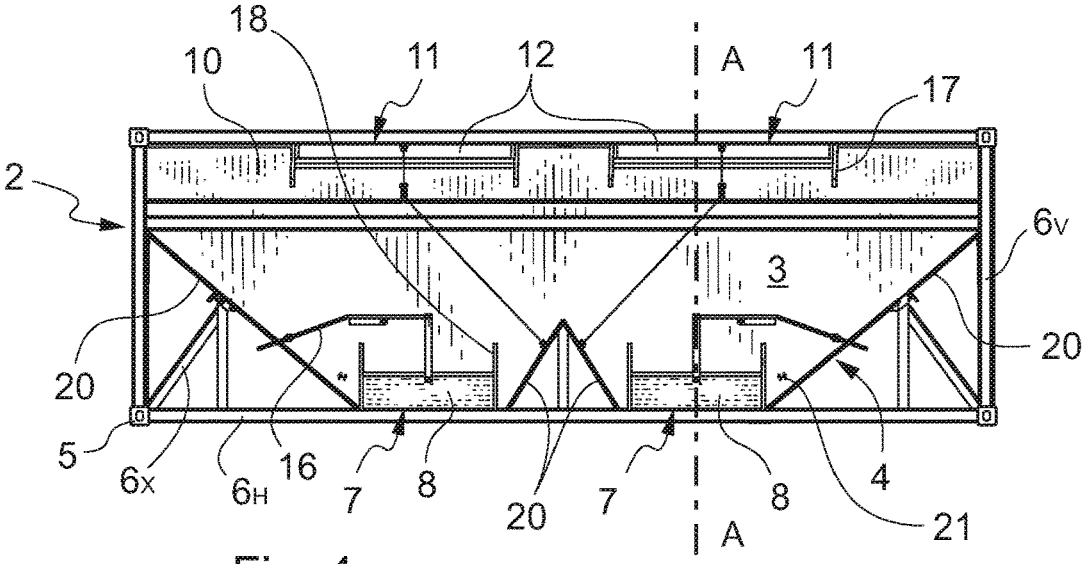
FIG. 4 is a side view of the hopper-in-frame according to FIG. 1, the illustrated side corresponds to the discharge lateral wall.
Figure 5:
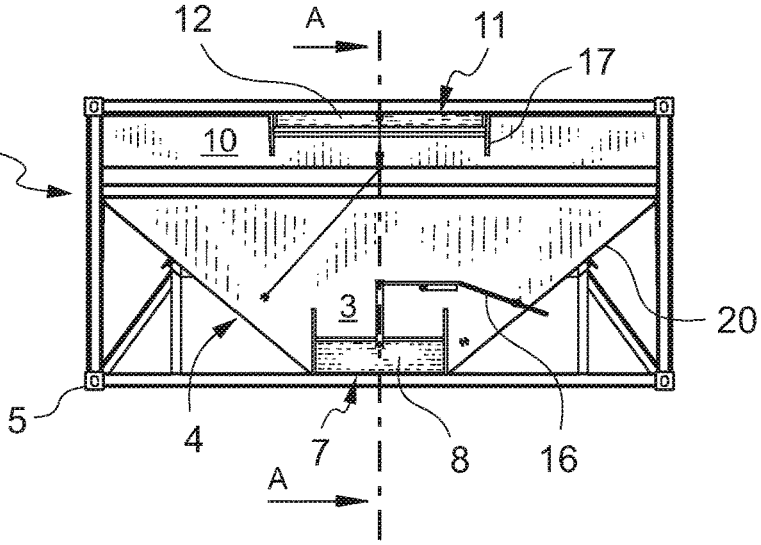
FIG. 5 is a side view of a hopper-in-frame according to a second preferred embodiment according to the improvements introduced in the present Utility Model with a shorter frame design than the one illustrated in FIG. 4, this time with an upper loading hatch and a lower lateral opening for unloading.

As will be well understood by one skilled in the art, FIGS. 1 to 3 illustrates a preferred way of practicing the structure of the frame (2), where it has been prioritized to obtain the highest rigidity with the least possible weight. Note, however, that any type of frame structure (2) can be carried out, as long as it allows to hold and delimit the hopper (1) without obstructing its operation and the movement of the moving parts, as will be described in more detail ahead.

FIGS. 1 and 3 illustrate the hopper-in-frame (30) stripped of the container (22), that is to say, dispensing with a complementary exterior cover, such as, could be presented by a standard container (22) as illustrated in FIG. 2.

It is therefore observed that the improved function of the hopper-in-frame of the present Utility Model is obtained from the components illustrated in FIGS. 1 and 3. However, it is clear that for practical purposes, the inclusion of an upper cover (25), lateral walls (23), front walls, and rear access door (24) including the conventional corner fittings (5) can be included in the Model herein proposed as a logical response to the conditions of use and local market regulations.

Particularly, when the hopper (1) is integrated or included within a standard container (22), the roof and walls of the outer container can be adapted in such a way as to allow superior access to the upper openings (11) for material entry in bulk and lateral access to the lower lateral discharge opening (7), being that this does not constitute any restriction to carry out the present Utility Model.

The hopper (1) is a closed container intended to contain bulk material, particularly suitable for containing granulated material, such as sand intended for use in wells as proppant or support material, a very common situation when dealing with oil wells subjected to Fracking "fracking". For practical purposes, the hopper (1) must be able to load the material inside it at the place of origin (quarry or another supply source of fracture sand), transporting said granular material safely, already at a truck, train or ship, and unloading said granular material in the place of destination (oil well installations) in the most efficient way possible. With respect to the latter (meaning the efficient discharge of the bulk material), the present Utility Model has the advantage that the proppant granular material can be completely discharged from the hopper (1) by gravity (avoiding forklifts, cranes, etc.), minimizing time and costs, simply by displacing a corresponding lower lateral gate (8) that closes a lower lateral discharge opening (7) included in a lateral wall (3) of hopper (1). Preferably, taking into account the general shape of the frame, the lateral wall (3) is generally vertical, constructed for example, with a cut and welded sheet.

Therefore, the discharge of the granular material (13) is not carried out as in the previous art, by the bottom of the hopper (under the level indicated with the reference "L") (See FIG. 7) and not even needing to pass through the center of the hopper, but directly to one side of the hopper (1), allowing the task to be made more efficient. Also, the fact of having a lower lateral discharge opening (7) allows easy coupling, sleeves, ducts or conveyor belts towards one from the sides of the hopper (See FIG. 7), which allows the operators an easy operation and visual verification of the work of connection, disconnection, calibration and operation of the assembly.

Clearly, one skilled in the art will understand the operational advantages of having this particular location of the discharge opening (7) in a lower lateral position above the level "L" at the time of expediting the discharge of material in the field of work. However, the inclusion of a lower lateral opening (7) for gravity discharge (meaning, without energy expenditure), involves the inclusion of a hopper bottom (4) formed by a plurality of inclined walls (19, 20) that they converge towards the corresponding lower lateral discharge opening (7) and therefore unbalance the load on the train, another container, truck or similar (See FIGS. 7 to 9), since the inclined wall, that is to say the lateral ramp (19) at the bottom (4) is asymmetric with respect to a vertical longitudinal plane of symmetry of the frame (2), and therefore the inclusion of a lower lateral discharge opening (7) in a hopper (1) with asymmetrically inclined bottom, produces an asymmetric load of the bulk material with respect to a plane of vertical longitudinal symmetry (direction of displacement of the load during its transport).

According to the prior art, the unbalance of the load within a conventional hopper does not occur because the hoppers of the market are structurally symmetrical, as will be referenced at least initially in the prior art documents cited herein.

On the contrary, the present Utility Model offers as a feature a lower lateral discharge opening (7) positioned level (reference "L" axis) above the platform of the tow truck and to counteract the essential part of the load imbalance includes a roof (10) including at least a portion of the roof lowered asymmetrically towards the side of the discharge wall (3).

Note, therefore, that the present Utility Model is useful and efficient in its function thanks to the structural combination of at least one lower lateral discharge opening (7) by which the bulk granular material can be discharged inside by the action of gravity to include a bottom (4) of hopper formed by a plurality of sloping walls that converge towards the corresponding lower lateral discharge opening (7) and which innovatively compensates the potential load imbalance by having a roof (10) including at least a portion of the roof lowered asymmetrically towards the side of the discharge wall (3). In particular, an effective way of implementing the roof (10) of the present Utility Model is by constructing the roof inclined asymmetrically with its downward slope towards the side of the discharge wall (3). In other words, the roof (10) is mansard, preferably the portion of the roof lowered asymmetrically is an inclined plate that extends the entire length of the hopper (1), for example, built on the basis of a smooth and flat sheet, being able to also extend from the edge to the side edge, however, it allows other constructive forms that act equivalently, such as slightly domed, corrugated, stepped, among others, as long as the final goal of the same is achieved, so a portion of the roof is asymmetrically lowered, effectively manages to move the granular material in the opposite direction to the discharge wall, and in this way compensate for any possible imbalance of load during the transportation.

For reference of the present Utility Model, the expressions "side of the discharge wall" or simply "discharge side", refer to the side of the hopper (1) that corresponds to the lateral wall (3) where there is at least one lower lateral discharge opening (7).

Therefore, the roof lowered asymmetrically towards the side of the discharge wall (3) forms what could be called a mansard roof (10), with at least one asymmetric inclination, thus allowing the upper part of the confined bulk material to the opposite side of the discharge side, (See FIG. 7), for example, by loading weight towards the side of the opposite wall, which could be referred to as a loft wall (9), in this way, the weight distribution within the hopper is sufficiently compensated to avoid oscillations and unbalance during transport. It is noted that, depending on the type of constructive rigidity sought, even the hopper itself (1) can include internal braces (15) as a structural reinforcement or as deviators or load absorbers.

To be known, the more asymmetrically lowered is the roof (10) of the hopper (meaning, the more sloping or inclined), the better is the compensation of the weight unbalance of the material loaded in the hopper. The practice indicates that the fuller is the hopper (1), the more harmful would be the weight imbalance on the height. However, the present Utility Model has demonstrated an amazing compensation of moving load (road and rail transport) thanks to the roof including the recessed portion (particularly the asymmetrically inclined roof (10)) descending to the unloading lateral discharge wall (3).

Figure 7:
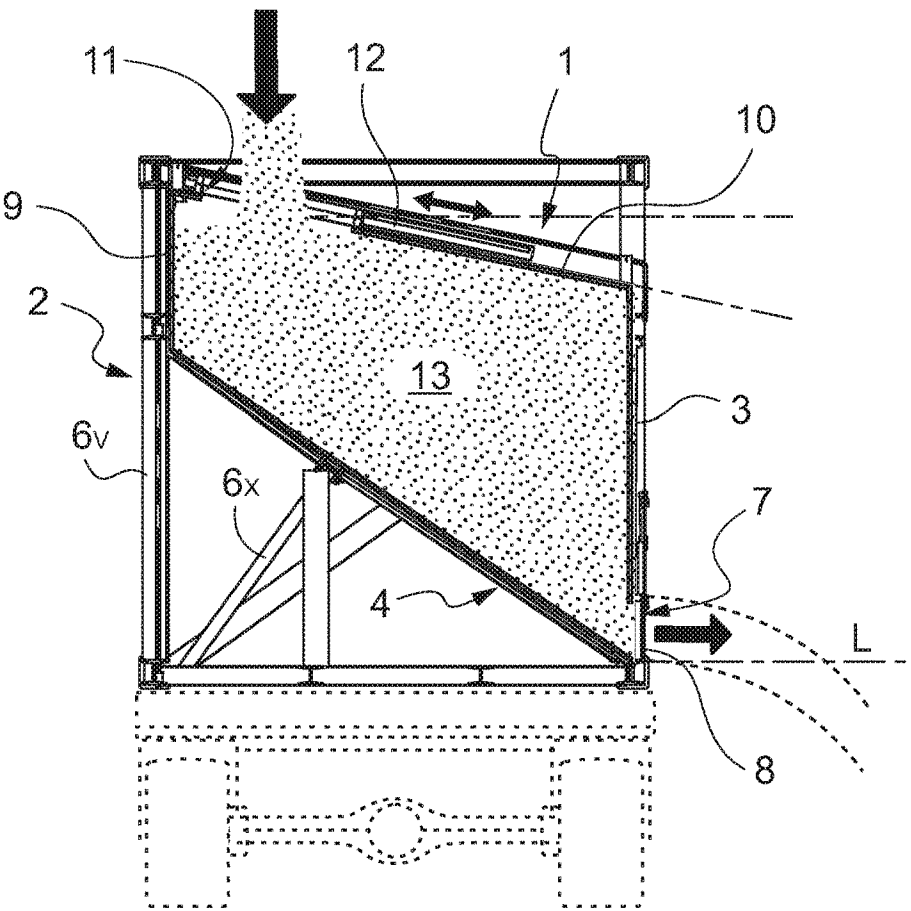
FIG. 7 is a cross-sectional view according to a transverse vertical plane passing through the line A-A, according to FIG. 6, illustrating the inside of the hopper, the upper arrow indicates the entry of bulk material and the lower right arrow indicates the exit of bulk material, a reference "L" indicates the lowest level of the hopper, and the upper double arrow indicates the direction of Sliding of the upper gate that for the figure is open and moved to the right.
Figure 6:
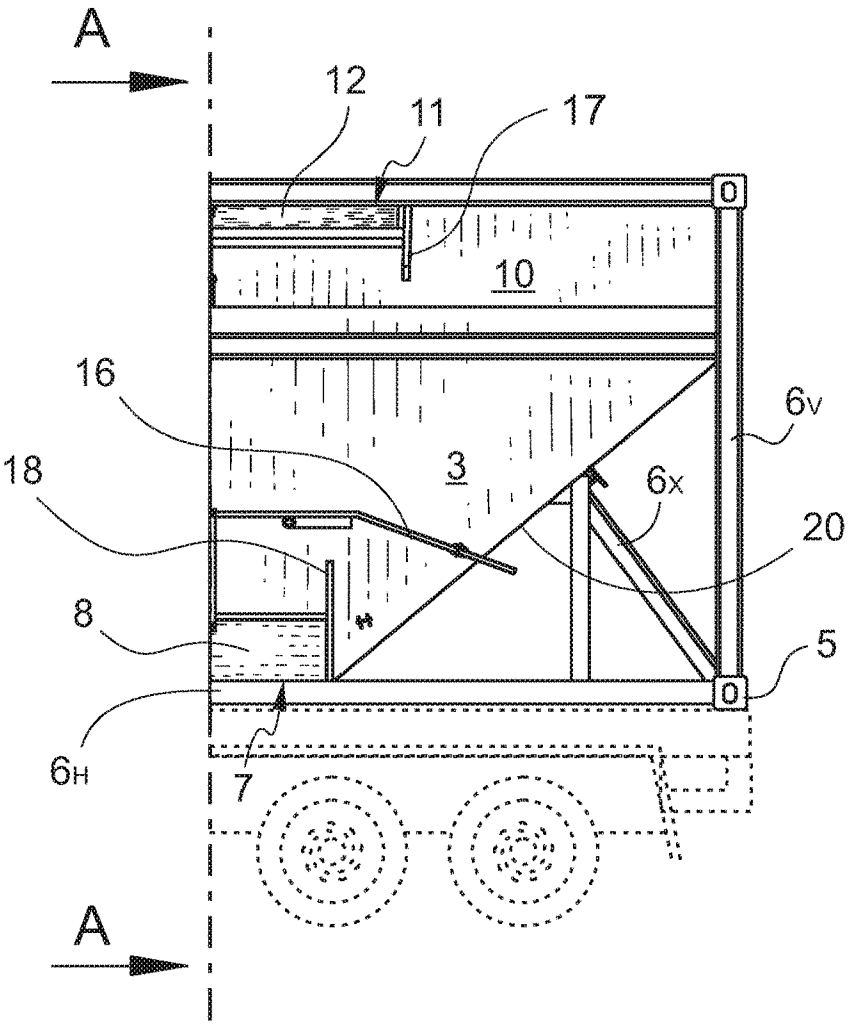
FIG. 6 is a partial side view of the portion taken to the right of a transverse vertical plane passing through line A-A, according to the hoppers-in-frame illustrated, according to the embodiments of FIGS. 4 and 5, for the reference purposes, the support platform of a truck-trailer on which they can be transported, has been illustrated in a dashed line.
Figure 8:
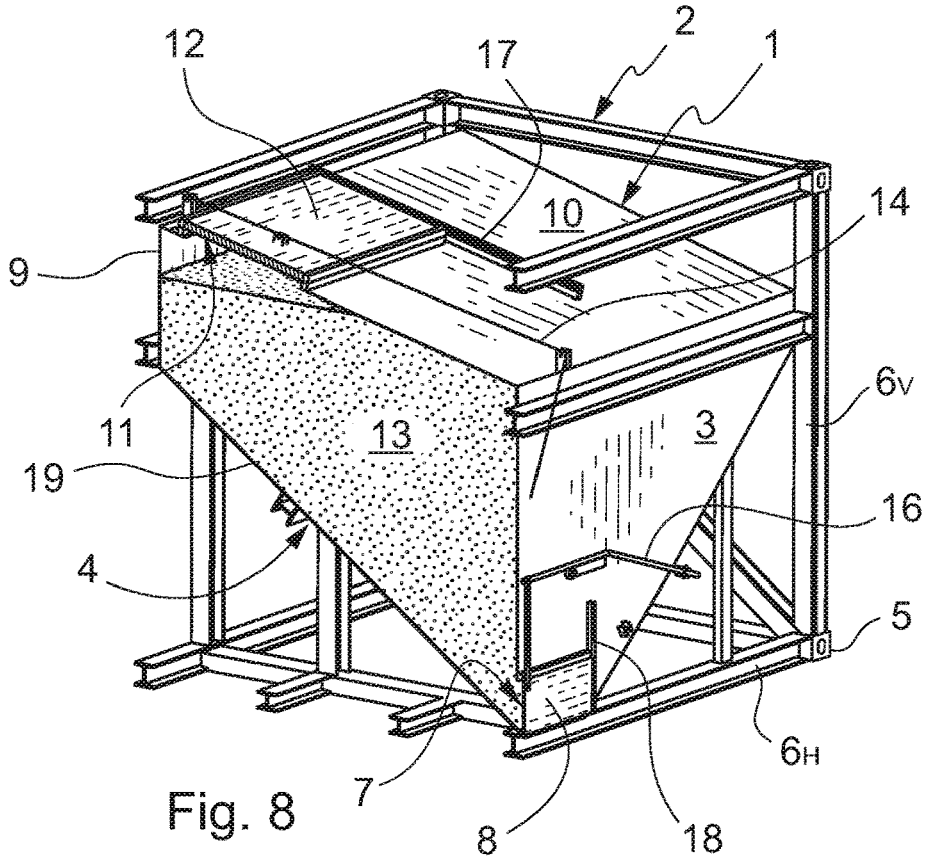
FIG. 8 is a cross-sectional perspective view according to FIG. 7, the hopper being fully loaded with bulk granular material (for example, proppant material such as sand for remediation and intervention of wells submitted to fracking).
Figure 9:
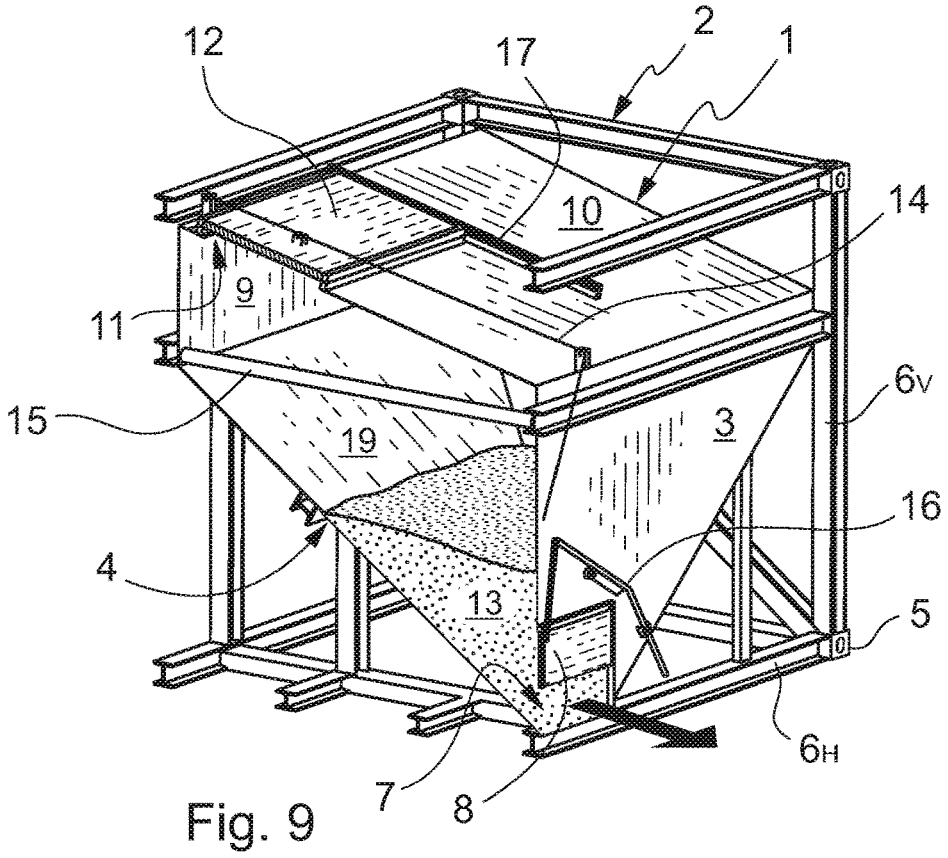
FIG. 9 is a perspective view and in cross-section in coincidence with FIG. 8, the bulk material inside the hopper is in the time just before finishing the discharge through the lower lateral opening of the discharge lateral wall, being the lateral gate open.

A clear example of the interaction of the asymmetric inclined roof (10) with the bulk granulated material contained inside the hopper (1) can be seen in FIGS. 7 to 9.

About the moment of loading the granulated bulk material into the hopper (1), FIG. 7 illustrates that the upper loading hatch (11) that is lockable by a corresponding upper hatch (12) is open, allowing the entry of the bulk material (13) from above.

The upper loading hatch (11) is located in the highest part of the roof (10), since it maximizes the loading capacity of the hopper because the roof includes a recessed portion (meaning a mansard roof or asymmetrically inclined portion). In said FIG. 7, the corresponding upper hatch (12) has been guided by a pair of guide rails (17), allowing the granulated bulk material (13) to get introduced inside the hopper (1) until the filling of the same.

For the reader's reference purposes, practice indicates that it is recommended to leave a safe separation distance between the upper loading hatch (11) and the upper surface of the granulated material (13) loaded inside the hopper (1), meaning, limiting the load of material to a level that does not come to overflow through the upper hatch (11) thinking about the moment of transport and bustle of the load. A suitable separation distance (top clearance) can be approximately 20 centimeters. However, and as one skilled in the art will well understand, this will depend on the shape of the recessed portion of the roof, the type of attic or roof inclination, the format of the upper loading hatch and the material to be transported. Also, other factors, such as the type of route to be followed by the means of transport, the expected super elevation of the route, etc. they may also condition or guide the maximum load level of the hopper in question, this being easily determined by the user.

The gates used to open and close the upper loading hatch(es) (11) and the lower lateral discharge opening(s) (7) can be carried the practice very easily by one skilled in the art. By way of reference only, a preferred way of putting them into practice is by their sliding construction in rectangular shape in smooth metal plate with rigid frame that includes skids that can slide over the respective rails (17, 18) installed in the proximity of the respective loading hatch (11) and lower lateral discharge opening (7). It is advisable to provide the hatches and the openings with a frame, that ensures a tight sealing once locked by the respective sliding gate, the way to obtain a good sliding and tight sealing is not a technical disadvantage that deserves special attention and does not constitute any limitation to the purposes of this Utility Model.

Because the upper hatch (12) is in the roof (10) of the hopper (1), to be able to maneuver it, it is convenient to include a drive cable (14), either a belt, chain, cable itself or similar, in such a way as to allow sliding of the upper hatch (12) to one side or the other, opening and closing the upper hatch (11). Note that various anchor points, guides, conductors, deviators or locks, meaning, various fittings (21), are set down in various places on the walls or roof, even on the frame, or where necessary, to allow maneuvering and securing said cable drive (14).

However, as one skilled in the art could well deduce, any actuation means may be provided to drive the sliding of any of the gates, that is, suitable driving means may be provided, according to the preference or need of the user, as hydraulic cylinders, pneumatic, electric motors, endless screws, lever mechanisms and gears, cams, etc. The latter does not constitute any limitation to the purposes of the present Utility Model.

The same considerations as above for the roof hatches are applicable with respect to the sliding gate(s) which lock or release the discharge of the bulk material (13) through the lower lateral discharge opening(s) (7), however, in the case of gates that are more accessible to the user, can be sliding actioned through a set of levers (16), which can adopt at least two positions, open and closed; also complemented with the corresponding fitting (21) to keep the gate in position, locking the set of levers (16) in open or closed position.

In accordance with everything described above and based on everything illustrated, a person skilled in the art will understand and be able to put into practice the present Utility Model perfectly, either in the example modes proposed here or in its various variant's equivalents.

Having thus specially described and determined the nature of the present Utility Model and at least one way in which it can be led into practice, it is declared to claim as property and exclusive right.

The invention claimed is:

1. A hopper-in-frame (30) for transporting a proppant material, the hopper-in-frame (30) comprising:

a frame (2) including beams, poles, and metal profiles;

a hopper (1) supported by the frame; wherein the hopper (1) comprises:

a lateral wall (3) including at least one lower lateral discharge opening (7), the lower lateral discharge opening is locked by a corresponding lower lateral gate (8);

a bottom (4) formed by a plurality of inclined walls (19, 20), the plurality of inclined walls converges towards the corresponding lower lateral discharge opening (7);

wherein the lateral discharge opening (7) is located above a lowest level (L) of the hopper;

wherein the proppant material is discharged by gravity directly into the lower lateral discharge opening (7);

a roof (10) including at least one upper loading hatch (11), the roof is locked by a corresponding upper hatch (12), wherein said roof (10) includes at least a portion that is lowered asymmetrically towards the lateral wall (3), avoiding unbalancing of the hopper-in-frame (30) during transport at maximum load level;

wherein the load contacts said at least a portion that is lowered asymmetrically towards the lateral wall.

2. The hopper-in-frame (30) according to claim 1, wherein the hopper (1) has an external quadrangular prismatic shape.

3. The hopper-in-frame (30) according to claim 1, wherein the frame (2) fits into a standard cargo container having corrugated walls (22).

* * * * *